US006142503A

United States Patent [19]

Forest et al.

[11] Patent Number: 6,142,503

[45] **Date of Patent: *Nov. 7, 2000**

[54] DEVICE FOR HOLDING A BOOT ON A SNOWBOARD

[75] Inventors: Vincent Forest, Annecy; Robert Maestri, Viuz la Chiesaz; Jean-Pierre Rigal, La Balme de Sillingy; Benoit Saillet, Albens, all of France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/952,107

[22] PCT Filed: May 20, 1996

[86] PCT No.: PCT/FR96/00751

§ 371 Date: Nov. 21, 1997

§ 102(e) Date: Nov. 21, 1997

[87] PCT Pub. No.: WO96/36407

PCT Pub. Date: Nov. 21, 1996

[30] Foreign Application Priority Data

May 18, 1995 [FR] France ..... 95 06168

[51] Int. Cl.[7] ..... A63C 9/02

[52] U.S. Cl. ..... 280/624; 280/14.2

[58] Field of Search ..... 280/14.2, 613, 280/624, 626, 631, 635, 607, 618; 36/117.3, 117.5

[56] References Cited

U.S. PATENT DOCUMENTS

| | | | |
|---|---|---|---|
| 2,803,467 | 8/1957 | Von Opel | 280/611 |
| 4,484,762 | 11/1984 | Salomon | 280/615 |
| 4,973,073 | 11/1990 | Raines et al. | 280/624 |
| 5,048,855 | 9/1991 | Girault et al. | 280/615 |
| 5,092,620 | 3/1992 | Girault et al. | 280/615 |
| 5,172,924 | 12/1992 | Barci | 280/14.2 |
| 5,505,477 | 4/1996 | Turner et al. | 280/613 |
| 5,520,406 | 5/1996 | Anderson et al. | 280/624 |
| 5,813,689 | 9/1998 | Mansure | 280/607 |
| 5,855,390 | 1/1999 | Hassell | 280/607 |

FOREIGN PATENT DOCUMENTS

| | | |
|---|---|---|
| 0525580 | 2/1993 | European Pat. Off. . |
| 2638373 | 5/1990 | France . |
| 2645758 | 10/1990 | France . |
| 2645759 | 10/1990 | France . |
| 2645760 | 10/1990 | France . |
| 2645764 | 10/1990 | France . |
| 2656227 | 6/1991 | France . |
| 2673546 | 9/1992 | France . |
| 9113766 | 4/1992 | Germany . |
| WO90/11109 | 10/1990 | WIPO . |
| WO95/09035 | 4/1995 | WIPO . |

*Primary Examiner*—Brian L. Johnson
*Assistant Examiner*—David R. Dunn
*Attorney, Agent, or Firm*—Greenblum & Bernstein, P.L.C.

[57] ABSTRACT

A retention device for a boot for use on glide boards adapted to be used for snowboarding. At least one attaching device of the retention device is offset laterally with respect to the median longitudinal plane of the boot and is positioned in the vicinity of only one side of the boot, either the lateral side or the medial side of the boot.

21 Claims, 9 Drawing Sheets

Y
α 2
α 3
P2
P3
1
4
10
7
11
5
IV
8
14
X'
0
X
IV
6
2
12
5
13
7
15
3
9
Y'

2
3
1
6
9
5
e
4
13
S
h2
h3

Fig: 13
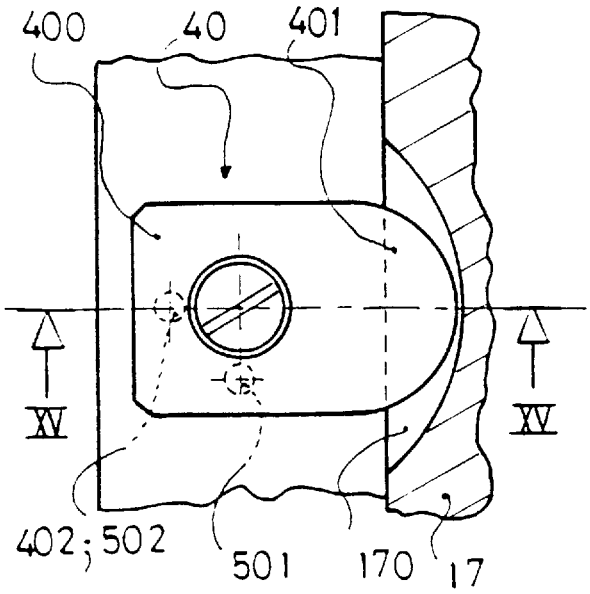
Fig: 14
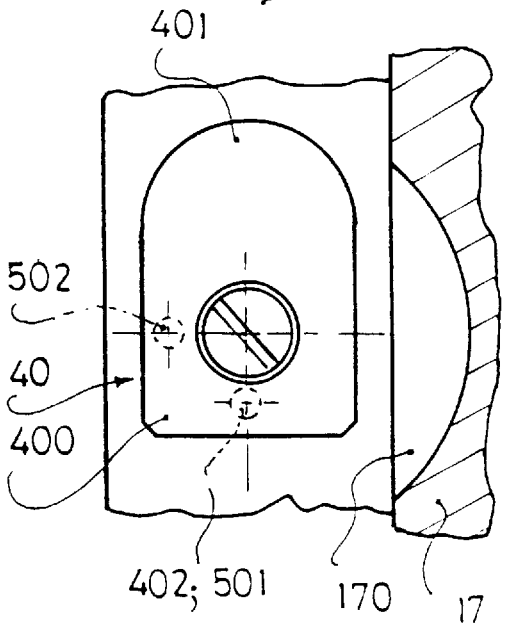
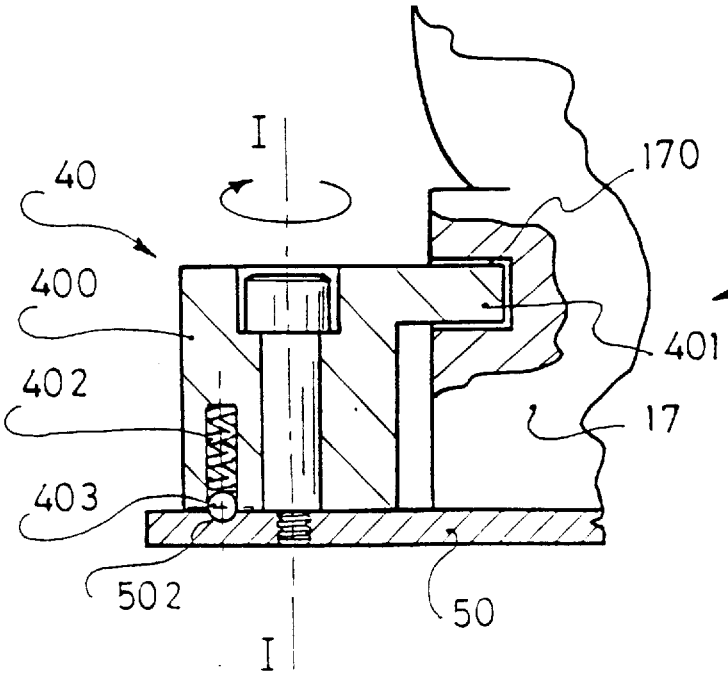
Fig: 15

DEVICE FOR HOLDING A BOOT ON A SNOWBOARD

BACKGROUND OF THE INVENTION

1. Field of the Invention

The invention is related to the field of glide boards intended for snow boarding and it is specifically related to a device for retaining a boot with respect to the snow board.

2. Description of Background and Relevant Information

Snow boarding is traditionally practiced with a glide board, known as a "board" that a user steers via forces that he generates with the movements of the body and the limbs. These forces are transmitted to the board by the lower limbs through the boots and the means for retaining the boots with respect to the glide board, known as "retention means". As a result, the steering of the board is at least partially influenced by the characteristics of the boots and the retention means, independently of all other parameters.

The user should be able to steer the board over the snow by following the trajectory that he wants, and he must also be able to lift the board as high as possible off the ground in order to execute artistic figures or pass over obstacles.

Prior art has suggested at least two broad categories of boots and boot retention means with respect to the board.

The first category consists of flexible shoes, or "boots", that are retained on the board by wedge and strap systems, an example thereof being provided by the document DE 91 13 766. The flexibility of the boots and the straps facilitates the user's leg movements.

However, the attaching operation of the boots on the board is not very convenient, particularly with regard to the tightening and adjustment of the straps, which takes up a lot of time.

In addition, these systems are voluminous and do not facilitate either the storage or the transportation of the boards.

The second category consists of more rigid boots, that are retained on the board by one or several bindings that generally cooperate with the heel and the tip of the shell base of the boot, one example thereof being provided by the document EP (A1) 525 580. The stiffness of the boot/binding assembly facilitates the precision with which the board is steered. However, the retention is too stiff and allows no potential for any looseness of the boot with respect to the board.

The document FR 2 673 546 has designed a solution with a boot rest support mounted pivotably on a base about an axis that is oriented along the longitudinal axis of the boot. However, this principle is also based on a concept of retention means for a rigid shell boot. The boot is mounted on the rest support by means of pivoting stirrups that retain the tip and the heel of the boot. The attaching operation remains delicate and inconvenient. It is done by engaging the heel in one of the pivoting stirrups and by manually actuating a lever that is affixed to the second stirrup in order to close the binding, while at the same time keeping the sole of the boot flat on the support plate. In addition, such a binding means is only suitable for retaining a rigid shell snow boarding boot and is not adapted for the retention of boots having flexible or semi-flexible uppers, which are in greater demand by today's practitioners.

The document WO 95/09035 suggests a binding system for a boot of the flexible type that does away with the straps, buckles and stirrups of traditional bindings. The system is based on a mechanism of jaws connected to a base, and it allows the engagement of an anchoring means affixed to the boot.

One of the disadvantages is that the attaching operation is done "blindly"; or in other words, the user does not have a clear view of the anchoring elements and the jaws across from each other during the attaching operation, and must therefore proceed with the correct positioning of the boot and the anchoring thereof by touch alone. In some circumstances, such as in deep snow, it becomes extremely difficult, if not impossible, to undertake the attaching operation of the board.

Another disadvantage is the necessity of connecting the central jaw to the control mechanism by a relatively long transverse shaft that is subject to substantial bending and torsional stresses that are capable of damaging the latching device.

SUMMARY OF THE INVENTION

It is an object of the instant invention to overcome the disadvantages of the prior art binding systems. One of its particular objects is to suggest a retention device that facilitates the attaching operation by minimizing the number of anchoring points and by locating them in such a way that they remain visible to the user.

Another object is also to suggest a construction for a retention device that is simpler and lighter than those known in the prior art.

Another object is to limit the volume requirements of the retention device.

Another object is to suggest a device that resists substantial stresses without the risk of getting damaged.

Another object is to suggest a construction that allows one to obtain, if needed, a certain lateral flexibility and looseness for the boot.

In order to do this, the invention suggests a device for retaining a boot on a glide board intended for snow boarding, known as retention device, the boot comprising mainly a sole affixed to an upper, the sole having a wear surface, the upper demarcating a front end, a lateral side, a rear end and a medial side, a median longitudinal plane being substantially perpendicular to the wear surface, wherein the device comprises a means for connecting the boot on the board constituted of an attachment means that cooperates by engagement with a latching means; and in that the connection means is offset laterally with respect to the longitudinal plane and is positioned in the vicinity of only one side of the boot; i.e., either the lateral side or the medial side of the boot.

Thus, the attaching operation is simplified by the lateral engagement of only one side of the boot on the board. This convenience also consists of allowing the user to have a direct view of the connecting means which thus are offset along one of the sides of the sole of the boot. The user can visually verify that the attaching operation has been undertaken correctly.

The invention thus provides a pledge of safety that is greater than those of existing systems, and especially with respect to the solution provided by the document WO 95/09035 where the feeding operation is undertaken "blindly".

According to an additional feature of the invention, the connection means is a journal means that allows a relative rocking movement of the boot with respect to the glide board. This arrangement allows the boot, and thus the foot, to get displaced, either in the direction of their spacing from, or in the direction of coming closer together to the upper surface of the board, when the boot rocks about the journal.

The user can space his foot from the board and then bring it back quickly, thus providing a stronger impulsion by virtue of a shock effect. As a result, the board becomes deformed in bending and stores up an energy that is more substantial than is the case in traditional devices. The advantage is that the user can jump higher when this energy is restored by the board when it resumes its normal shape.

According to another feature of the invention, the journal means comprises a rotational axis contained in the plane that is substantially parallel to the wear surface forming, with the median longitudinal plane, an angle comprised between −45 and +45 degrees.

This natural design provides the boot, and consequently the foot, with a degree of rotational freedom that facilitates the movements of the lower limbs of the user, and enables his movements to have a greater amplitude without altering the traditional functions of retention devices that are linked to the transmission of impulse forces or the receipt of sensory information.

One advantage is that the rotational movements of the foot allow the user to substantially improve his performance without additional fatigue, especially when he is involved in acrobatics.

In a complementary manner, the retention device as per the invention is designed to include at least one elastic return means that resists the rocking movement of the boot with respect to the glide board, so as to bring the sole closer to the glide board. The elastic return means can accumulate the energy that it transmits to the boot so as to improve the shock effect. The elastic return means reduces the user's fatigue by encouraging the reestablishment of support and contact of the boot on the board. It also allows backlash elimination during the feeding operation.

BRIEF DESCRIPTION OF THE DRAWINGS

Other characteristics and advantages of the invention will be better understood with the help of the following description, with respect to the annexed drawings illustrating, as non-restrictive examples, how the invention can be obtained and wherein:

FIG. 13 is a top view of a detail of FIG. 12 in a first engagement configuration, FIG. 14 is a top view similar to FIG. 13 in a second engagement configuration, FIG. 15 is a section along XV—XV of the view of FIG. 13;

DETAILED DESCRIPTION OF THE INVENTION

Figure 1:
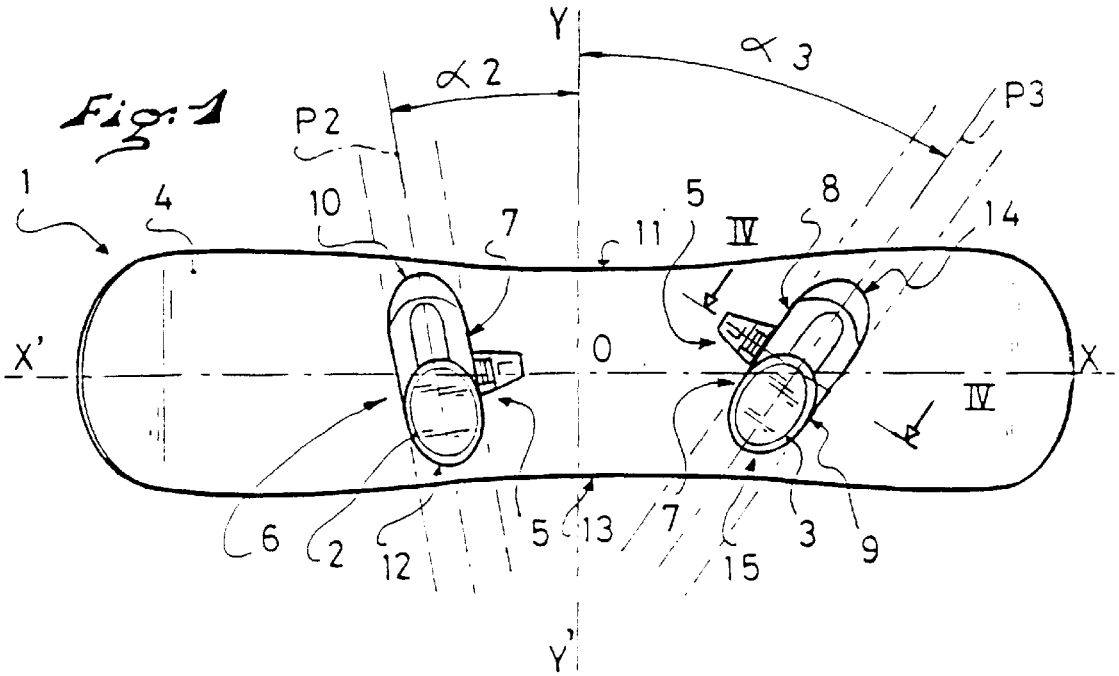
FIG. 1 is a top view of a glide board on which two boots are retained via devices as per the invention.

A glide board 1 intended for snow boarding, known as the "board" is represented in a top view in FIG. 1. A left boot 2 and a right boot 3 are each retained with respect to the upper surface 4 of the board 1 by devices 5 that will be described hereinafter.

For reasons of simplicity, the user of the board has not been represented in the drawings.

X–X' denotes the central longitudinal axis and Y–Y' denotes the central transverse axis of the board 1. The intersection of the axes X–X' and Y–Y' is a point O that allows the definition of an orthonormal reference (O, X, Y) that is substantially centered along the upper surface 4 of board 1. The left 2 and right 3 boots each have respectively one longitudinal plane P2 and P3 that is substantially perpendicular to the wear sole of the boot.

The longitudinal plane P2 of the left boot 2 is median and located at a substantially equal distance from a lateral side 6 and a medial side 7 of the boot 2, whereas the longitudinal plane P3 of the right boot is median and located at a substantially equal distance from a medial side 8 and a lateral side 9 of the boot 3.

Here, the left boot 2 is positioned in a half-plane containing the half-axis O–X', and is oriented along its longitudinal plane P2 by an angle value $\alpha 2$ with respect to the axis Y–Y'.

Similarly, the right boot 3 is positioned in a half-plane containing the half-axis O–X, and is oriented along its longitudinal plane P3 by an angle value $\alpha 3$ with respect to the axis Y–Y'.

A front end 10 of the left boot 2 is located, with respect to a lateral edge 11 of board 1, at a distance that is substantially equal to the distance separating a rear end 12 of the left boot 2 from a lateral edge 13 of the board 1 opposite the lateral edge 11.

Similarly, a front end 14 of the right boot 3 is located, with respect to edge 11, at a distance that is substantially equal to the distance separating a rear end 15 of the right boot 3 from an edge 13.

Naturally, the values of the orientation angles $\alpha 2$ and $\alpha 3$ of the boots 2 and 3 can vary from one user to another, as can the distances separating the boots 2, 3 from the center O.

In parallel, the front ends 10, 14 and rear ends 12, 15 of the boots 2 and 3 could also be oriented in an inverse manner with respect to the lateral edges 11 and 13, depending on whether the user favors his left or right side.

Figure 2:
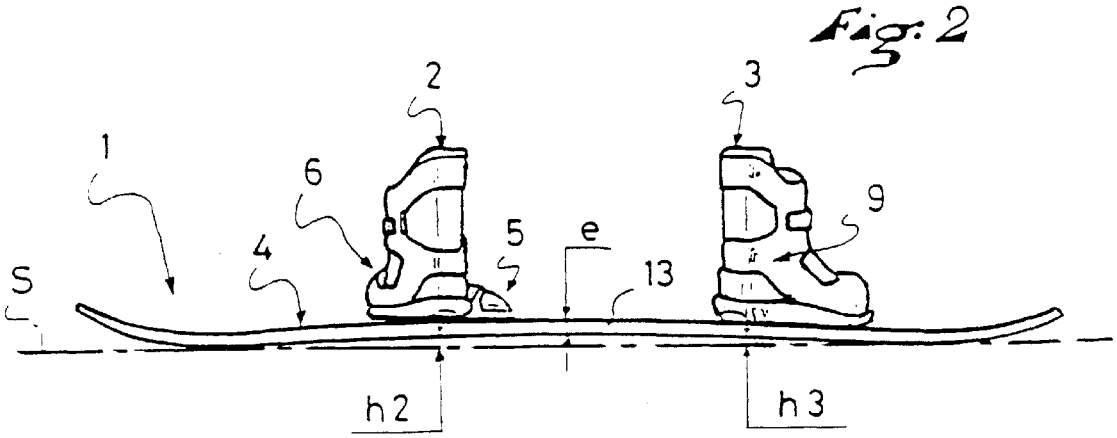
FIG. 2 is a side view of the board of FIG. 1.

A side view of board 1 with the boots 2, 3 and the retention devices 5 is shown in FIG. 2, wherein the board 1 is contact with a substantially flat ground S. The board forms an arc that raises each boot 2, 3 with respect to the ground S, in addition to the thickness of the board, by a height h2 in the case of boot 2 and a height h3 in the case of boot 3. As described hereinafter, the arched shape of the board allows it to store up energy by deformation under the action of the forces originating from the user through the boots 2, 3 and/or the retention devices 5.

Moreover, these retention devices 5 can be positioned either on the medial side, or on the lateral side of a boot, depending on the gliding style and/or jumps practiced by the user.

Figure 3:
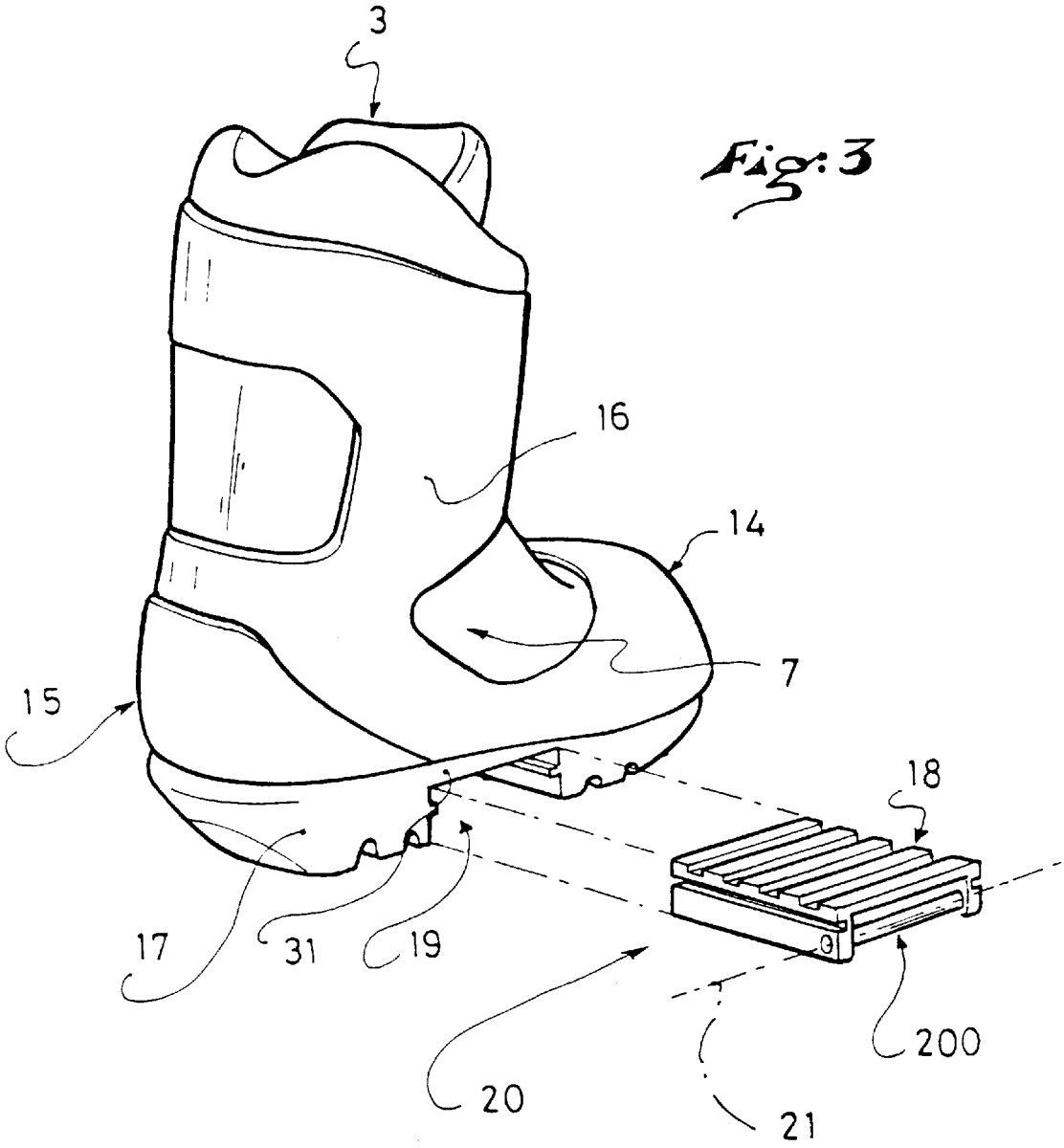
FIG. 3 is an example of a boot adapted to the device as per the invention.

In the example of FIGS. 1 and 2, a retention device 5 located on the medial side 7 for the left boot 2 and for the right boot 3 has been used; an example of the right boot 3 has been illustrated in FIG. 3.

When the boot rocks, this arrangement of the retention device 5 towards the inside allows the knees to be brought towards the inside (or the medial side). This thus responds to a natural need linked to the practice of snow boarding in order to make turns or execute some acrobatic movements (making jumps, for example).

However, this arrangement is not restrictive and one could envision an arrangement wherein the retention devices 5 are towards the outside and cause, on the contrary, a bending of the board by a return action of the knees.

Figure 4:
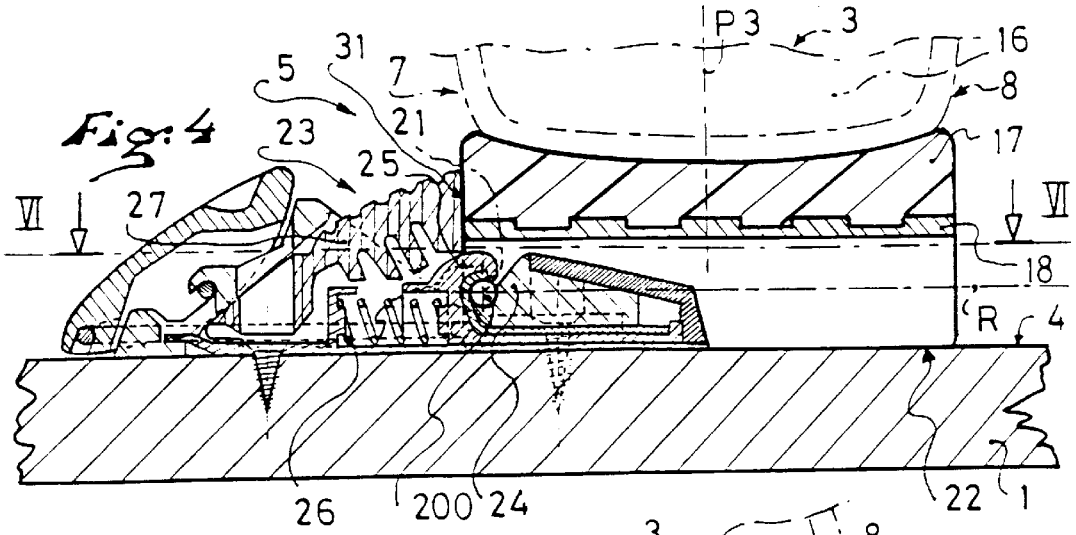
FIG. 4 is a section along IV—IV of FIG. 1, illustrating the retention device and the boot in support on the board.

The right boot 3, known as "boot 3" in the remainder of this description, comprises an upper 16 and a sole 17. The rear 15 and front 14 ends as well as the lateral side 9 are visible in FIG. 3. An insert 18, represented as a "U" shaped beam is designed to be affixed to the sole 17 in a notch 19, for example, by being imprisoned during the injection of the component material of the sole 17. Several grooves, formed on the surface of the insert 18 in contact with the sole 17, help to obtain a non-detachable, solid connection between the insert 18 and the sole 17. An attachment means 20 of the boot in the shape of a journal 200 extending along axis 21 is affixed to the insert 18, such that the axis 21 is positioned in the vicinity of the sole on the medial side 7 of boot 3. Here, the axis 21 is substantially parallel to the median longitudinal plane P3 of the boot 3. The journal 200 is thus affixed to the boot 3 and is integrated into the retention device 5 which is represented in a section for example in FIG. 4; this drawing shows the boot 3 in support by a wear surface 22 of sole 17 on the upper surface 4 of the board 1, as well as retained with respect to the board 1 by the device 5.

The device 5 is in fact constituted by the association of the journal 200 with a latching mechanism 23 acting as a support to the journal 200.

The latching mechanism or support 23 is fixed to the upper surface 4 of the board 1, and has been described in great detail in the documents FR 2 638 373, FR 2 645 758, FR 2, 645 759 and FR 2 645 760 in the name of the Applicant.

The journal 200 affixed to the boot 3 is housed in a housing of the support 23 affixed to the board 1 so as to together form a connection means, especially, a journal means allowing the rocking of the boot 3 with respect to board 1. The housing, spaced, is demarcated by the fixed jaws 24 and mobile jaws 25 of the support 23, that cooperate in order to retain the journal 200 with a possibility for the rotation thereof about the axis 21. The mobile jaw 25 enables the journal 200 to be retained in the space of support 23. The jaw is mobile in translation for its passage from the open to the closed position, and vice-versa.

In our example, the mobile jaw 25 can be displaced against the action of an 5 elastic means, represented in the form of a spring 26, that biases the mobile jaw 25 towards a position wherein the housing space for the journal 200 is closed.

Such a construction has a certain number of advantages; specifically, the attaching operation becomes essentially simple and easy due to the presence of a single connection means between the boot and the board, the means being formed by the cooperation of the attachment means 20 and the latching means 23. In addition, the connection means is located on one side of the boot (and on one side only), such that the user can verify the correct engagement of the attachment means 20 in the space of the latching means 23.

Besides, such a construction is less voluminous and heavy that the binding systems known in the prior art, such as "plate" or "shell" binding systems.

Finally, the locking of the attachment means 20 in the space of the latching means 23 is done automatically by a simple substantially vertical pressure of the attachment means 20 with respect to the latching means.

Figure 5:
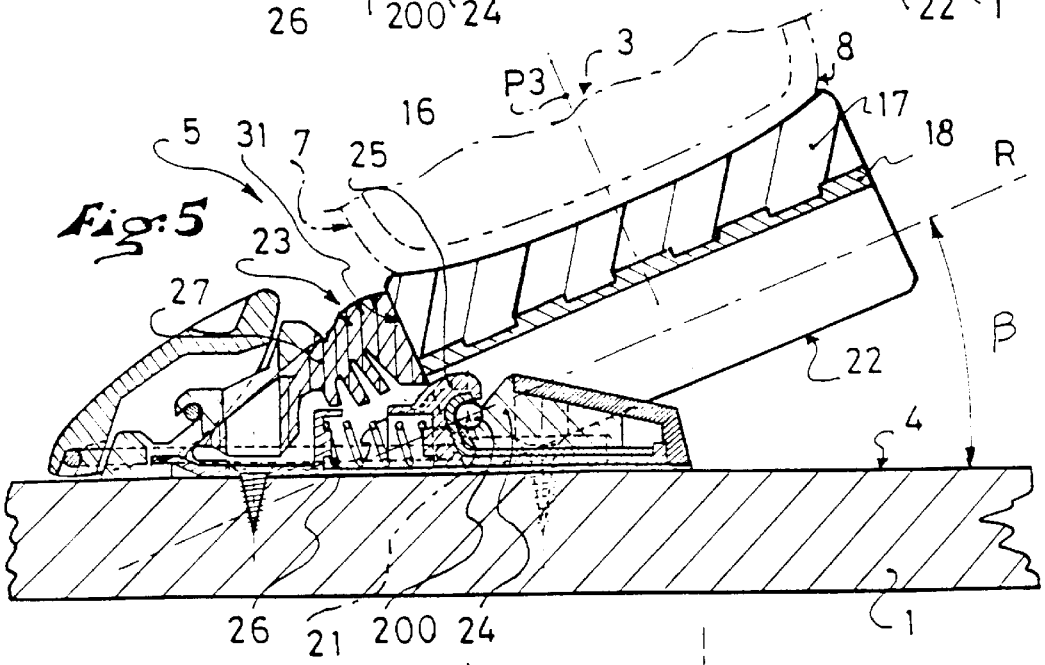
FIG. 5 is similar to FIG. 4 where the boot has rotated about a rotational axis of the retention device.

FIG. 5 shows how the boot 3 can pivot about axis 21 with respect to the board 1. The axis 21 is contained in a retention plane R that is substantially parallel to the wear surface 22 of sole 17 of boot 3. Together with the upper surface 4 of board 1, the retention plane R forms an angle β which translates the inclination of the sole 17 with respect to board 1 during the rocking.

In practice, this possibility of rocking on one side only, and in this specific case, of the pure rotational movement about axis 21 allows the user to amplify the forces that he can transmit to board 1 by executing movements with the body and limbs: the foot can be spaced from the board 1 and then come back towards board 1.

Alternating the movements amplifies the intensity of the user's impulse forces by virtue of the fact that the axis 21 is offset with respect to the longitudinal plane P3 of boot 3. As a result, at the moment of the exertion of an impulse force, the board 1 becomes flattened more than a board using a traditional retention device, thus storing additional energy that will make the user rise higher when this energy is restored by the board.

The rocking can be controlled by the presence of an elastic return means for the boot 3 towards the glide board 1, represented in the form of an elastomer block 27. By becoming compressed, the block resists the rotational movement of boot 3 in the case where it rotates to be spaced from the upper surface 4. By being compressed, the block 27 becomes capable of restoring the energy to push the boot 3 back towards the board 1, by taking support on a lateral surface 31 of the sole 17. The hardness and the elasticity of the material is selected in accordance with certain usage criteria and according to the users. For example, for users having little mass and a very relaxed style, the material will be more pliable and shock absorbent. On the contrary, for a user having substantial mass in addition to a very athletic style, the material will be selected from among hard and very resilient rubbers, for example. In an extreme case, the elastic return means can be replaced by a rigid abutment element that prevents any rocking after the feeding operation.

Figure 6:
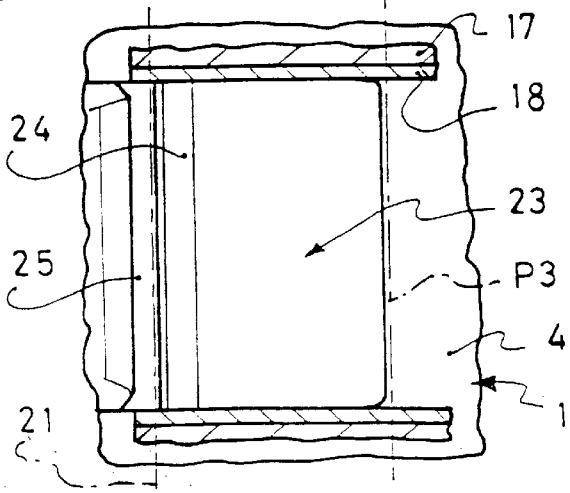
FIG. 6 is a section along VI—VI of FIG. 4.

Further, the user has the use of all the other usual functions of traditional devices, since the boot 3 is immobilized in the direction of the axis 21, as has been shown in FIG. 6.

The contacts between the walls of the insert 18 with the walls of the support 23 prevent a relative translation of the boot 3 and the board 1 in a direction parallel to the axis 21.

Preferably, the journal means, constituted here by the association of the journal 200 with the latching means 23, is located substantially at the center of the distance separating the front 14 and rear 15 ends of the boot 3. This arrangement enables an easier substitution of a right-sided user by a left-sided user or vice-versa.

The embodiment that has just been described uses a retention device 5 for a boot 2, 3 with respect to a glide board 1 which has other advantages that were highlighted in the documents cited previously. For example, the insertion of the journal 200 in the reception space demarcated by the jaws 24, 25 of the latching means 23 is achieved by a simple pressure of the foot. This embodiment has the advantage of being solid, practical, functional and reliable.

The retention device 5 is constructed with conventional means known to a person of the art. The materials are mainly, plastics that are reinforced or otherwise, metals and rubbers.

Figure 7:
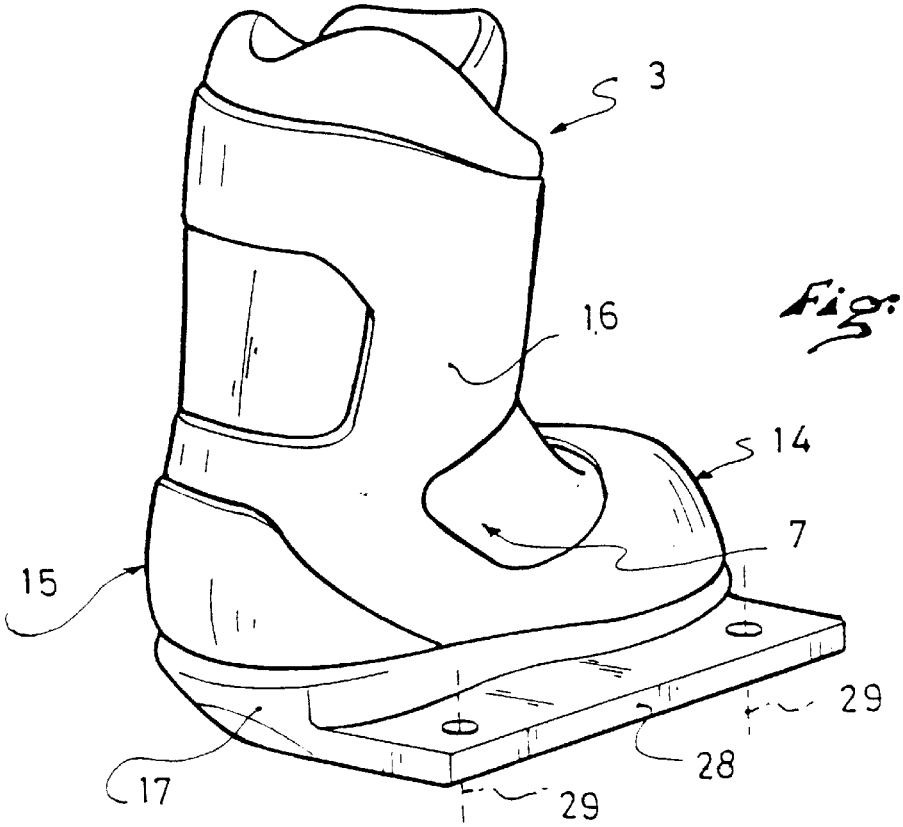
FIG. 7 is a boot for a retention device as per an embodiment variation.
Figure 8:
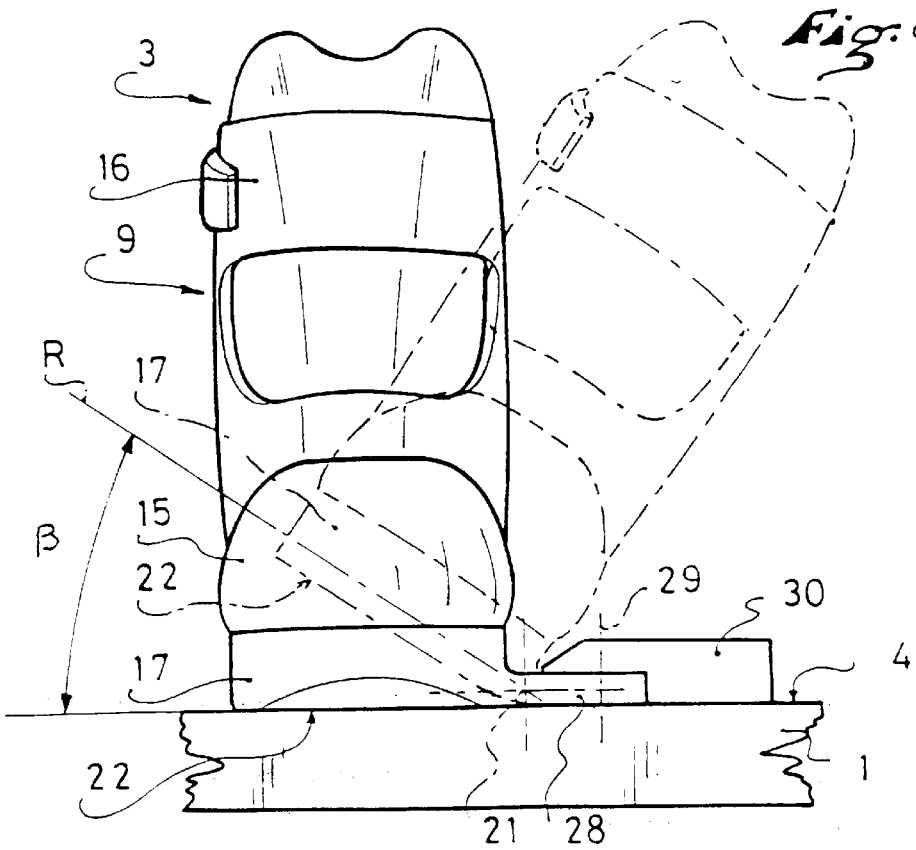
FIG. 8 shows how the boot rocks as per the embodiment variation of FIG. 7.

In addition to the embodiment illustrated in FIGS. 7 and 8, other embodiments can be envisioned.

For reasons of convenience, the common parts have been designated by the same references. A right boot 3 is visible in FIG. 7; it has an upper 16 mainly demarcating a rear end 15, a medial side 7, and a front end 14. The upper 16 is affixed to a sole 17, which comprises a lateral extension 28 bored by two axis holes 29.

As can be seen from FIG. 8, the boot 3 is retained on the upper surface 4 of board 1 by a jaw 30. Pins that have not been represented are affixed to jaw 30 and are housed in the axis holes 29. The jaw 30 is retained on the board 1 by any means known to a person of the art. The dotted and dashed part of FIG. 8 shows that the boot 3 is capable of pivoting about an imaginary axis 21 by the simple bending of the lateral extension 28 of sole 17. A retention plane R containing the axis 21 and being substantially parallel to the wear surface 22 of sole 17 has pivoted by an angle value β with respect to the upper surface 4 of board 1.

This embodiment has the advantage of being extremely economical and simple to manufacture.

Figure 9:
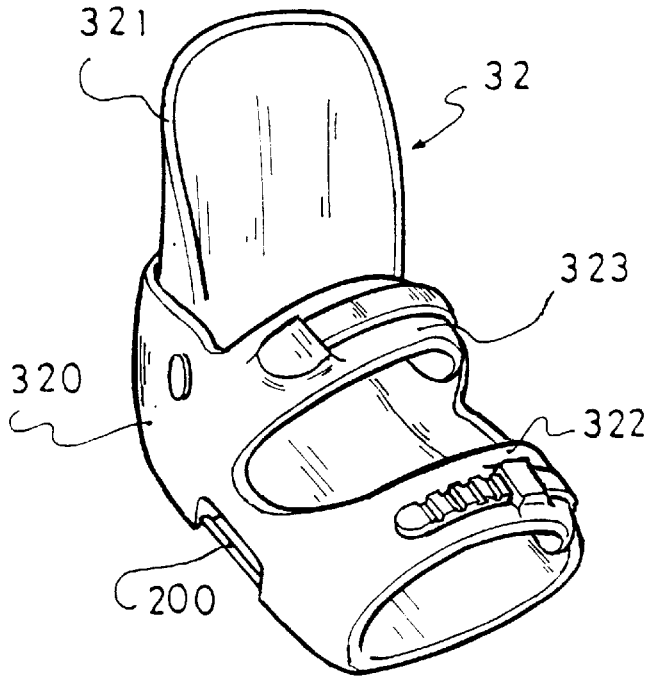
FIG. 9 illustrates a variation of a portion of the device which is like a "shell" binding element.
Figure 10:
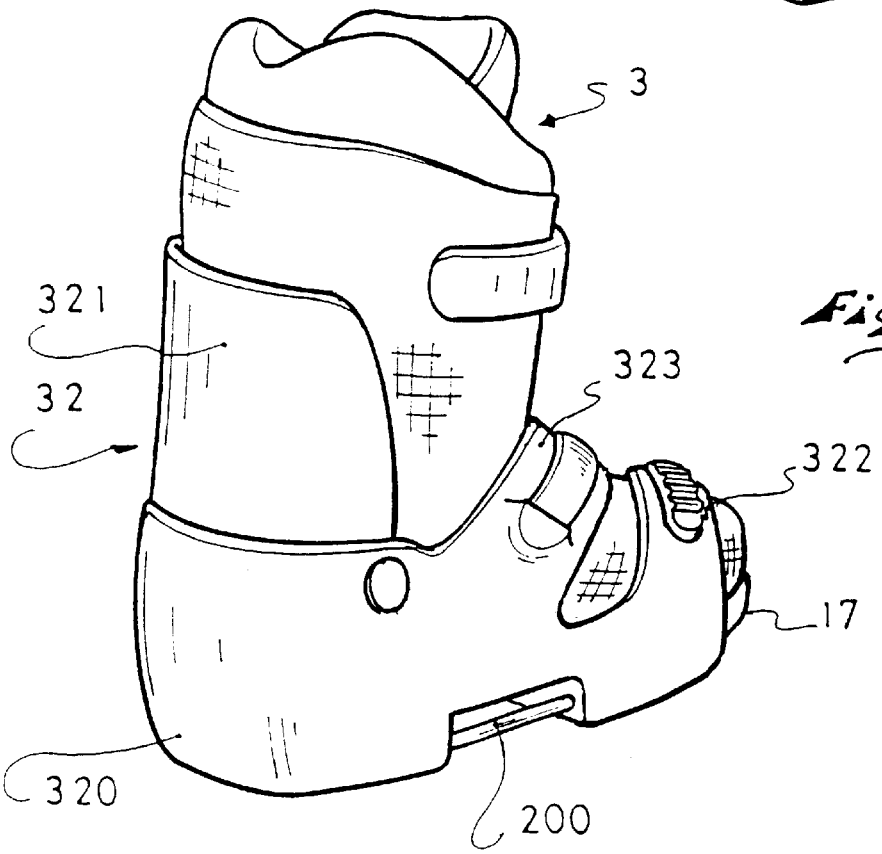
FIG. 10 is a perspective view of the integral assembly formed by a snow boarding boot and a "shell" binding element as per FIG. 9.
Figure 11:
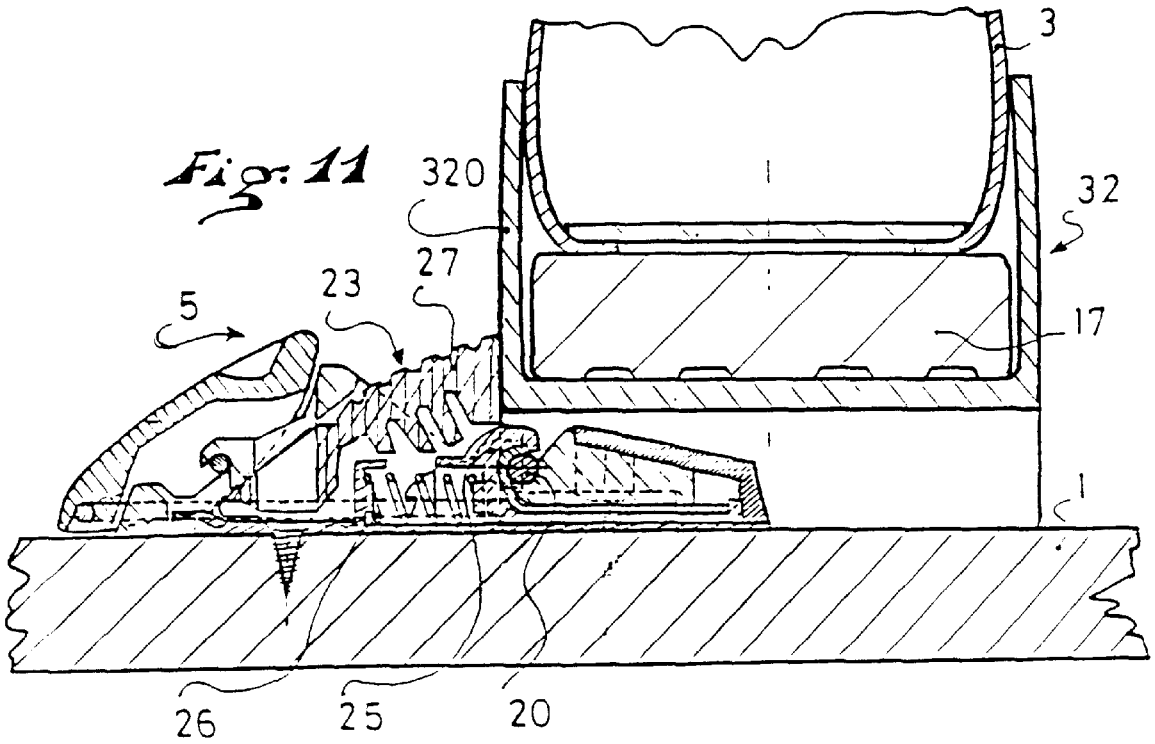
FIG. 11 is a sectional view similar to that of FIG. 4 as regards the variation of FIGS. 9 and 10.
Figure 12:
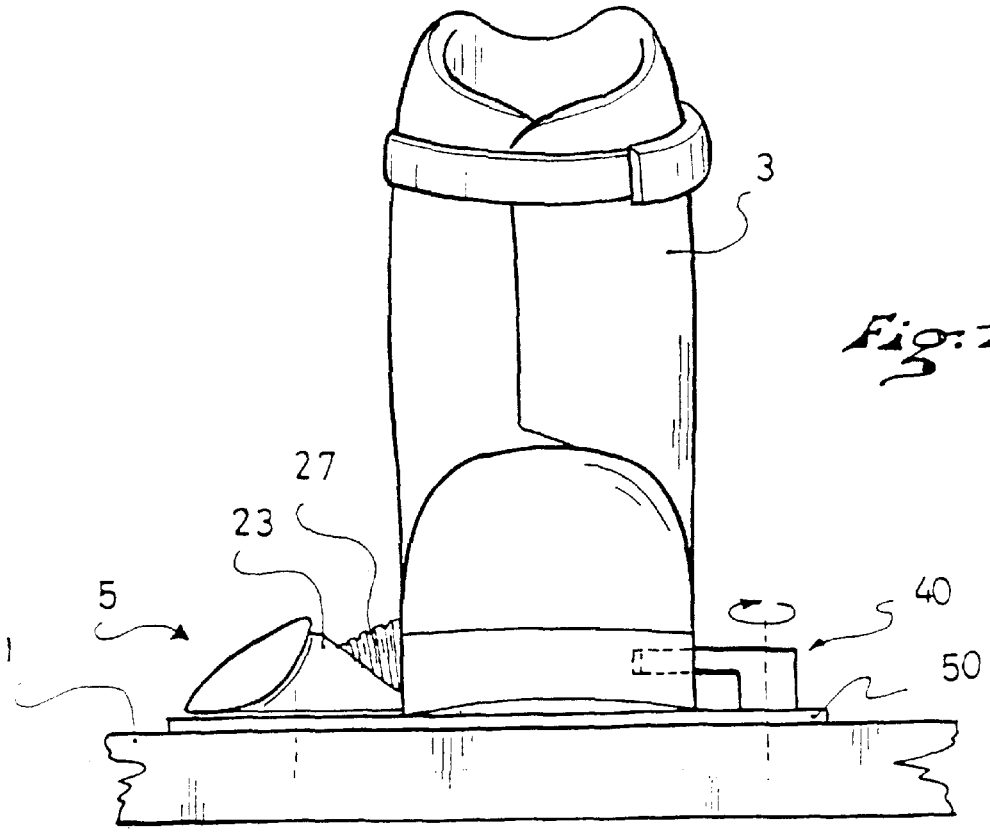
FIG. 12 is a frontal view of an embodiment variation of the device with a boot adapted thereto.

FIGS. 9 through 11 show a variation of the invention wherein the boot is not in direct engagement with the support of the retention device by means of a journal affixed to the boot. In this case, the attachment means 20 which is a journal 200 is affixed to a binding harness 32 adapted to retain a snow boarding boot 3 of the flexible type.

The binding harness 32 comprises a base 320 upon which the sole 17 of the boot rests, a rear spoiler 321 journalled on the base and which provides a rear support to the snow boarder's leg, a first tightening means for the front of the foot 322 mounted on the base as well as a second tightening means for the instep 323, also mounted on the base.

FIG. 10 shows a snow boarding boot 3 in the tightening position within the binding harness 32. In principle and during normal use, the tightening of the means 322 and 323 affix the boot, and especially its sole 17 to the base 320 of element 32 such that the journal connected to the base can also be considered to be affixed to the sole of the boot from a mechanical perspective.

The association of the harness 32 with the support 23 constituting the retention device 5 is illustrated in FIG. 1. It differs from the previous embodiments in that the elastic return means in the form of block 27 takes support on the lateral surface of base 320, and not directly on the sole 17 of boot 3. Preferably, this lateral support surface can be constituted of reinforced plastic or comprise a metallic insert that is attached or buried in a plastic material so as to be sufficiently stiff and store the supports without any substantial deformation.

Naturally, one could envision replacing the binding harness by any other type of binding element that is independent of the shoe or boot.

Under some usage conditions, and especially as regards technically challenging passages over difficult or hilly terrain, or while climbing onto mechanical lifts, it could prove useful, perhaps even indispensable, to completely strap the boot on the board of the snow board without providing any rocking potential. In this case, it would be necessary to provide a detachable latching system, as has been represented in the examples of FIGS. 12 through 15.

The retention device 5 comprises a plate 50 connected to the snow board on which is fixed the journal means comprising the support 23 on either the medial or the lateral sides of boot 3 so as to allow it to rock, as described previously. On the opposite side from the side of the boot comprising the journal means, is located a detachable latching means 40, said latching mechanism preventing the rocking of the boot with respect to the board in the engagement position, and inversely, allowing the rocking of the boot in the disengagement position.

As its base, the latching mechanism 40 has a blocking element 400 mounted 5 rotationally about a vertical axis I on plate 50 and comprises a horizontal finger 401 that is engaged into a slot 170 of the boot sole 17 in the latching or engagement position. The horizontal finger preferably has a circular or rounded engagement end so as to allow its free rotation about the axis I without getting caught on the edge of the sole or inside the slot 170.

In order to ensure that it becomes blocked into position, the blocking element 400 has an inner boring that is off-centered with respect to the axis I and exits via a lower orifice beneath the lower surface of the element in contact with the plate. A spring 402 is housed in the boring, said spring thrusting against a ball 403 that juts out slightly from the boring by the lower orifice.

The plate 50 is equipped with two hollow and hemispherical housings 501, 502 that are adapted to receive the ball 403, and thereafter block the blocking element 400 into position.

In the position corresponding to FIGS. 13 and 15, the ball 400 is engaged in the rear housing 502, and firmly retains the rotating element 400 in the engaged latching position, such that any rocking movement of the boot becomes impossible.

In order to pass from this position to the one represented in FIG. 14, one needs only to exert a manual rotational action on the blocking element so as to overcome the thrust of spring 402. In the case of FIG. 14, the ball then becomes engaged in the lateral housing 501 and the finger 401 becomes disengaged from the slot 170, such that the rocking of the boot about the journal means on the opposite side becomes possible once again.

Naturally, it is to be understood that the detachable latching means 40 described and represented as an example can also take the form of any other equivalent thereof. It is in this context that it becomes easy to envision easily replacing this system by a more rudimentary means associated to the retention device, such as a strap allowing the boot to be strapped onto the board under certain conditions of use.

Figure 16:
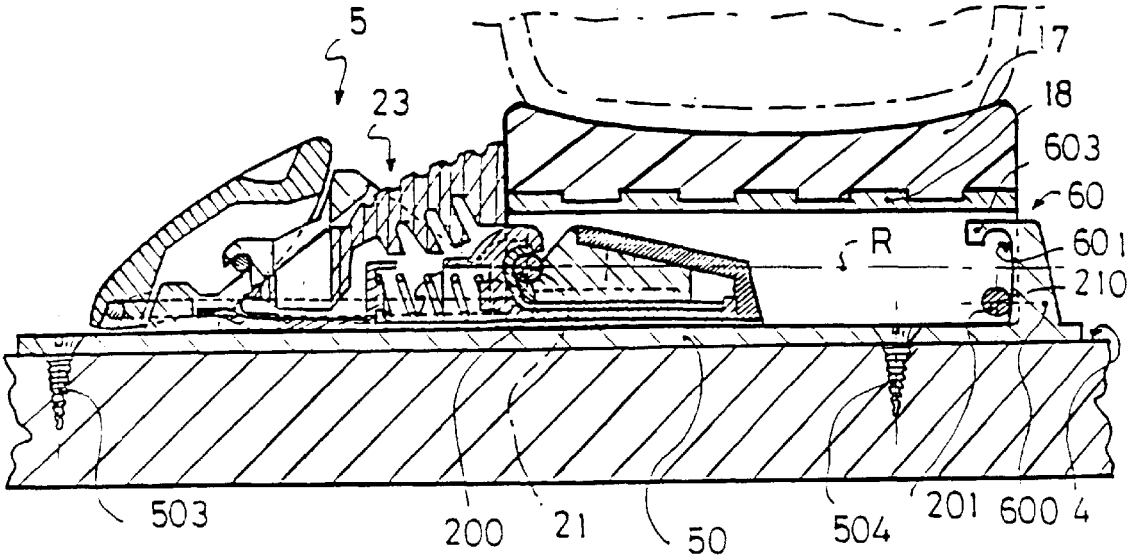
FIG. 16 is a view similar to that of FIG. 4 as per another variation of the invention.

In some cases, it may also prove necessary for reasons of performance and/or safety of the device to control the rocking of the boot about its journal. To this end, FIGS. 16 and 17 illustrate a non-restrictive example of a retention device 5 as per the invention to which a means 60 for limiting the rocking amplitude has been added.

The retention device 5 comprises a plate 50 connected to the board by screws 503, 504 for example, on which the sole 17 of the boot rests. The actual journal means that comprises the support 23 is positioned on one side of the boot so as to allow its rocking about a first journal 200.

On the opposite side, where this journal means is positioned, a means 60 for limiting the rocking amplitude is also affixed to the plate 50 of the retention means.

Figure 17:
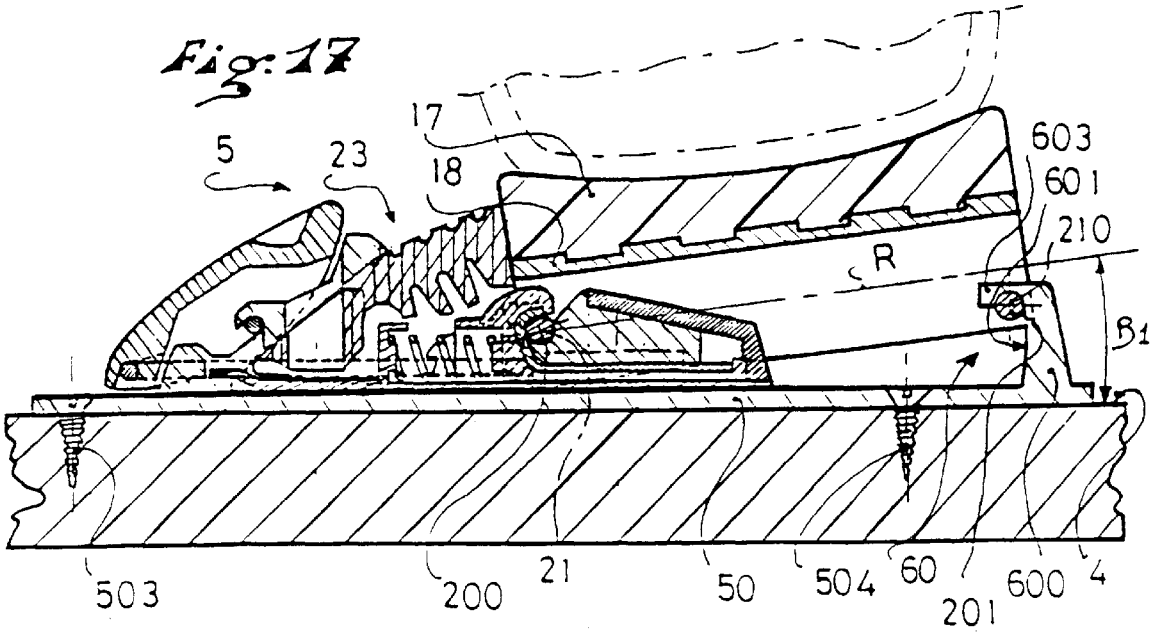
FIG. 17 is a view similar to that of FIG. 5 as per a variation of FIG. 16.

This means 60 comprises a second journal 201 of the axis 210 substantially parallel to the axis 21 of the first journal 200. Such second journal 201 is affixed to the boot in the same manner; for example, to the insert 18 in contact with the sole 17. It is engaged in the opening 601 of a "C" shaped element 600. In its main direction, the opening 601 extends in a substantially arched manner so as to allow the free displacement of the journal during the rocking phase about the rotational axis 21. Its length is selected depending on the path that one wants to allow the journal for a maximum inclination of the retention plane R with respect to the upper surface 4 of the board angle β1 (FIG. 17). Once this angle value is achieved, the journal comes in contact with the upper edge 603 of the element 600 that acts as an abutment and stops the boot in the inclined position.

The attaching of the boot in the retention device provided in FIGS. 16 and 17 can thus be done easily, first, by the lateral engagement of the journal 201 in the opening 601 by inclining the boot slightly and by impressing a lateral movement in the direction of the opening; then, secondly, by latching the first journal 200 in the automatic latching means by exerting a vertical pressure of the foot in the direction of the board.

Figure 18:
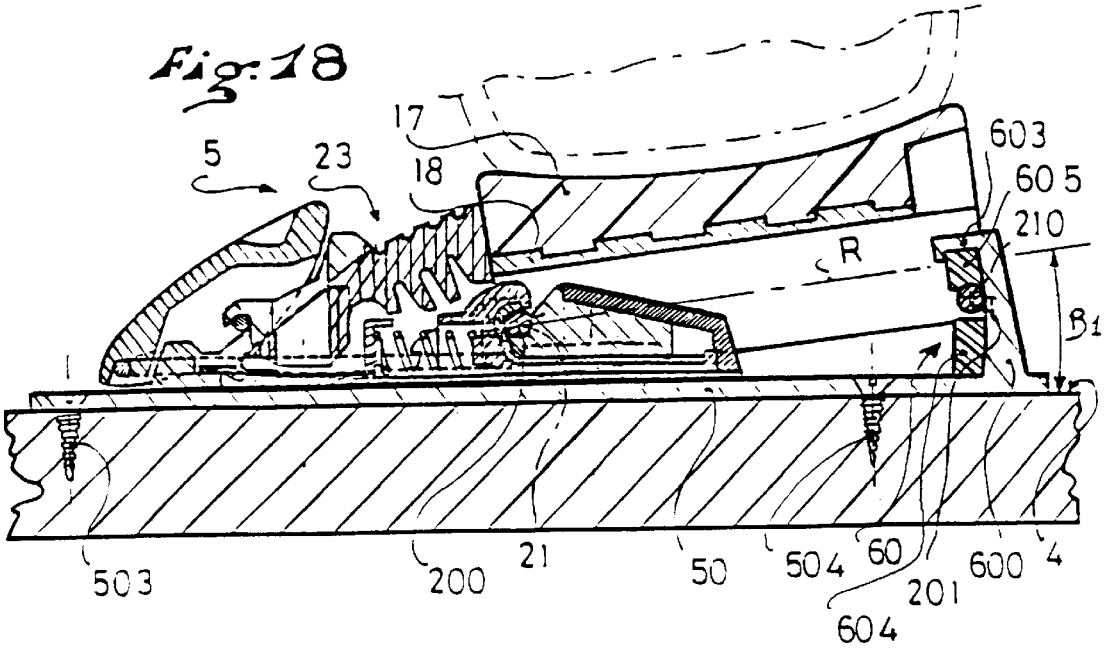
FIG. 18 is a view similar to that of FIG. 17 as per a variation.

FIG. 18 illustrates a variation of the previous embodiment wherein elastomer blocks are interposed in the opening 601 for a dampened contact of the second journal 201 within the amplitude limiting means. The lower block 604 encourages the dampening of the journal during a descent and the upper block 605 encourages dampening during an ascent. The stiffness of the blocks 604, 605 can be comparatively different and provide a stiffer contact during an ascent rather than a descent, for example, or vice-versa.

Figure 19:
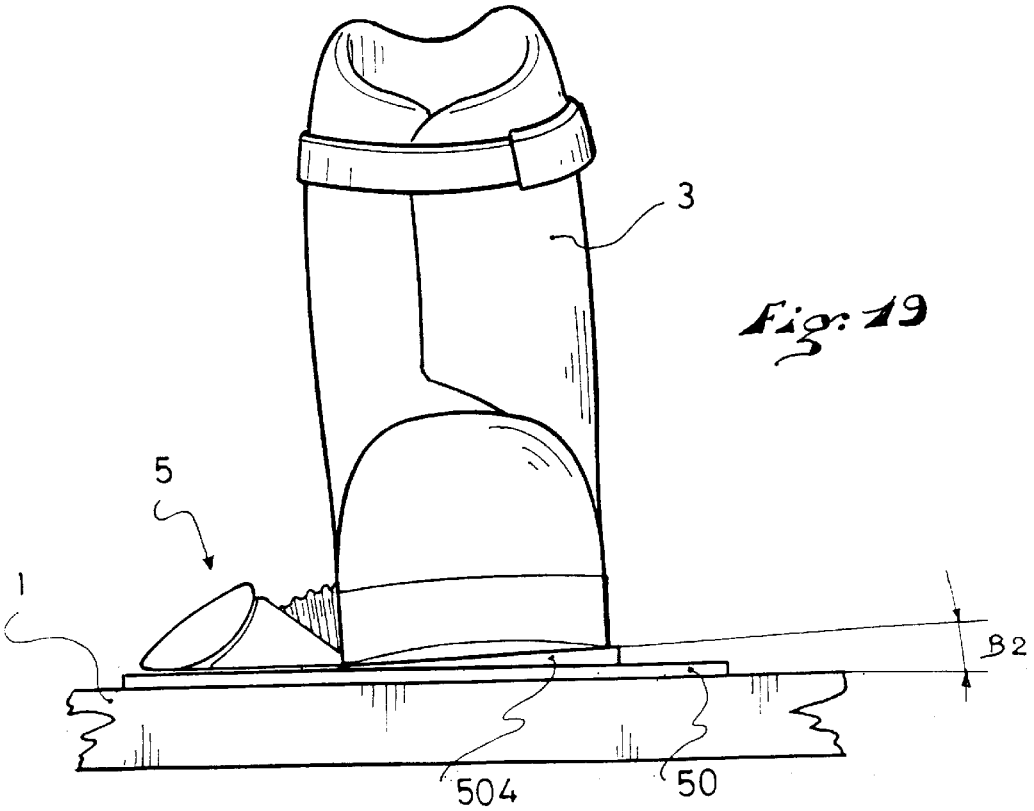
FIG. 19 is a view similar to that of FIG. 12 as per another variation.

The device of FIG. 19 has a plate 50 that is connected to the snow board 1 and comprises a wedge 504 for adjusting the angle of inclination β2 between the sole of the boot at rest and the surface of the board. This wedge can be attached and fixed to the plate 50 by any means such as adhesion or screwing for example. Wedging the inclination of the boot when at rest can prove important in the correction of some morphological problems, of the knee for instance, which afflict a certain category of people. In the example represented, the angle of inclination β2 is positive but naturally, the wedge can also have a negative inclination −β2 with respect to the board depending on the need for correction.

It is to be understood that the angular amplitude of the rocking movement can be controlled by means that are substantially different in their shape or design, without however, leaving the scope of the instant invention. Improvements can also be made, such as associating to it, a means for adjusting the rocking amplitude, for example.

It can also be noted that the elastic return means of the device can be replaced by a compression spring and that a means for adjusting the tension and/or path of the spring can be associated thereto.

The elastic return means can have different hardnesses depending on the requirements. It can have substantial hardness in order to act as an abutment means, and totally prevent any rocking of the boot under normal conditions of use. In this case, the invention would be limited only to the advantages linked to the simplification and ease of the feeding operation offered by the offset connecting means, as explained previously.

Naturally, the invention is not limited to the embodiments described herein, and also comprises all technical equivalents that could enter within the scope of the following claims.

One could especially provide a retention device for a boot on a board wherein the journal is affixed to the board, and the support mechanism is integrated to the sole of the boot.

What is claimed is:

1. An assembly of a boot and a retention device for attaching the boot onto a gliding board adapted for snowboarding, said assembly comprising:

at least one boot comprising:

a sole having a wear surface, the boot having a longitudinal median plane substantially perpendicular to said wear surface;

an upper affixed to said sole, said upper demarcating a front end, a rear end, a lateral side, and a medial side of said boot; and at least one journal extending along a journal axis, all of said at least one journal being positioned on a single side of said boot and laterally offset with respect to said longitudinal median plane, said single side of said boot being said lateral side or said medial side;

a retention device adapted to be fixed to the gliding board and to retain only the single side of said boot on the gliding board when said retention device is fixed to the gliding board, said retention device comprising a moveable latching mechanism, said latching mechanism comprising a structure defining a housing for receiving and latching said at least one journal and for allowing a repeated tilting movement of said boot about said journal axis, wherein only the single side of the boot is retained by the retention device when the at least one journal is pivotally retained by the latching mechanism.

2. An assembly according to claim 1, wherein:

each of said at least one journal extends substantially longitudinally.

3. An assembly according to claim 1, wherein:

said latching mechanism of said retention device comprises a retractable jaw mounted for translation between a latching position, in which said journal is retained by said retention device, and an open position, in which said journal is insertable and removable with respect to said retention device.

4. An assembly according to claim 3, wherein:

said latching mechanism comprises an elastic means exerting a biasing force on said retractable jaw towards said latching position.

5. An assembly according to claim 4, wherein:

said journal is located substantially in the middle of a distance separating said front and rear ends of said boot.

6. An assembly according to claim 1, wherein:

said journal axis is contained in a plane substantially parallel to said wear surface forming an angle comprised between ±45 degrees with said median longitudinal plane.

7. An assembly according to claim 6, wherein:

said journal axis is substantially parallel to said median longitudinal plane.

8. An assembly according to claim 1, wherein:

said retention device comprises at least one elastic return mechanism opposing said tilting movement of said boot about said journal axis, tending to bias said sole in a direction toward the glide board.

9. An assembly according to claim 8, wherein:

said elastic return mechanism is an elastomer block.

10. An assembly according to claim 9, wherein said elastomer block is in engagement with a lateral surface of said sole.

11. An assembly according to claim 1, further comprising:

a boot binding element independent of said boot, said boot binding element immobilizing said boot, said journal being affixed to said boot binding element.

12. An assembly according to claim 11, wherein:

said boot binding element comprises a base, a rear spoiler journalled on said base, a first tightening means for a forefoot portion of said boot, and a second tightening means for an instep of said boot, said tightening means being mounted on said base.

13. An assembly according to claim 1, further comprising:

a detachable latching mechanism located on a side of said boot opposite from said single side, said detachable latching mechanism comprising a structure to prevent, in an engagement position, a relative pivoting movement of said boot with respect to the glide board.

14. An assembly according to claim 13, wherein:

said detachable latching mechanism comprises a means for controlling an amplitude of said pivoting movement of said opposite side of said boot.

15. An assembly of a boot binding element and a retention device for attaching the boot binding element onto a gliding board adapted for snowboarding, said assembly comprising:

at least one boot harness, said boot harness comprising a base with a lower surface, said boot harness having a longitudinal median plane substantially perpendicular to said lower surface, said boot harness demarcating a front end, a rear end, a lateral side, and a medial side of said boot harness, and at least one journal extending along ajournal axis, all of said at least one journal being positioned on a single side of said boot harness and laterally offset with respect to said longitudinal median plane, said single side of said boot harness being said lateral side or said medial side;

a retention device adapted to be fixed to the gliding board and to retain only the single side of said boot harness on the gliding board when said retention device is fixed to the gliding board, said retention device comprising a moveable latching mechanism, said latching mechanism comprising a structure defining a housing for receiving and latching said at least one journal and for allowing a repeated tilting movement of said boot harness about said journal axis, wherein only the single side of the boot is retained by the retention device when the at least one journal is pivotally retained by the latching mechanism.

16. An assembly of a boot and a retention device for attaching the boot onto a gliding board adapted for snowboarding, said assembly comprising:

at least one boot comprising:

a sole having a wear surface, the boot having a longitudinal median plane substantially perpendicular to said wear surface;

an upper affixed to said sole, said upper demarcating a front end, a rear end, a lateral side, and a medial side of said boot; and at least one journal extending along a journal axis, all of said at least one journal being positioned on a single side of said boot and laterally offset with respect to said longitudinal median plane, said single side of said boot being said lateral side or said medial side;

a retention device comprising means for latching only the single side of said boot to the glide board and for allowing repetitive pivoting of said boot about said journal axis while in a latching position of said retention device, wherein only the single side of the boot is retained by the retention device when the at least one journal is pivotally retained by the means for latching.

17. A boot adapted to be retained on a gliding board adapted for snowboarding, said boot comprising:

a sole having a wear surface, the boot having a longitudinal median plane substantially perpendicular to said wear surface;

an upper affixed to said sole, said upper demarcating a front end, a rear end, a lateral side, and a medial side of said boot; and at least one journal extending along a journal axis, all of said at least one journal being positioned on a single side of said boot, laterally offset with respect to said longitudinal median plane, said single side of said boot being said lateral side or said medial side, said journal comprising at least a portion adapted to be removably engaged by a retention device having a moveable member to retain only the single side of said boot on the gliding board, wherein only the single side of the boot is retained by the retention device when the at least one journal is pivotally retained by the retention device.

18. A boot according to claim 17, wherein:

said journal axis is substantially parallel to said median longitudinal plane.

19. A harness for a snowboarding boot adapted to cooperate with a retention device for retaining said harness on a snowboard, said harness comprising:

a base for receiving and supporting a sole of the snowboarding boot, said base having a lower surface, the harness having a longitudinal median plane substantially perpendicular to said lower surface of said base, the harness further having a front end, a rear end, a lateral side, and a medial side, and at least one journal affixed to said base, said journal extending along a journal axis, all of said at least one journal being positioned on a single side of the harness and laterally offset with respect to said longitudinal median plane, said single side of said harness being said lateral side or said medial side, wherein only the single side of the harness is adapted to be retained by the retention device having a moveable member when the at least one journal is pivotally retained by the retention device.

20. A harness according to claim 19, further comprising:

a rear spoiler journalled on said base, and a plurality of tightening elements for tightening the boot on said base.

21. The combination of a foot interface device and a retention device for attaching the foot interface device to a gliding board adapted for snowboarding, the combination comprising:

the foot interface device being one of a boot and a binding harness and comprising a sole having a wear surface, a longitudinal median plane substantially perpendicular to the wear surface, an upper affixed to the sole, said upper demarcating a front end, a rear end, a lateral side, and a medial side of the foot interface device;

at least one journal arranged only on a single side, said single side comprising one of the lateral side and the medial side of the sole, the at least one journal being substantially parallel and laterally offset with respect to said longitudinal median plane;

a retention device configured to be fixed to the gliding board and to pivotally retain the foot interface device on the gliding board, the retention device comprising a moveable latching mechanism for removably engaging the at least one journal, wherein only the single side of the foot interface device is retained by the retention device when the at least one journal is pivotally retained by the latching mechanism.

* * * * *